US010995593B2

(12) United States Patent
Saraya et al.

(10) Patent No.: US 10,995,593 B2
(45) **Date of Patent: *May 4, 2021**

(54) METHODS AND SYSTEMS FOR CONTROLLING SUBSTANCES FLOWING THROUGH IN AN INNER DIAMETER OF A TOOL

(71) Applicant: Vertice Oil Tools, Missouri City, TX (US)

(72) Inventors: Mohamed Ibrahim Saraya, Sugar Land, TX (US); Jarle Trones, Sandnes (NO); Kristoffer Braekke, Stavanger (NO)

(73) Assignee: VERTICE OIL TOOLS INC., Missouri City, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/517,606

(22) Filed: Jul. 21, 2019

(65) Prior Publication Data

US 2019/0345798 A1 Nov. 14, 2019

Related U.S. Application Data

(63) Continuation of application No. PCT/US2018/047516, filed on Aug. 22, 2018, which is a continuation of application No. 15/698,358, filed on Sep. 7, 2017, now Pat. No. 10,400,555.

(51) Int. Cl.

| | |
|---|---|
| ***E21B 43/26*** | (2006.01) |
| ***E21B 34/14*** | (2006.01) |
| ***E21B 43/08*** | (2006.01) |
| ***E21B 34/10*** | (2006.01) |

(52) U.S. Cl.

CPC ..... *E21B 43/08* (2013.01); *E21B 34/10* (2013.01); *E21B 34/102* (2013.01); *E21B 34/142* (2020.05); *E21B 43/26* (2013.01); *E21B 2200/06* (2020.05)

(58) Field of Classification Search

CPC ..... E21B 34/10; E21B 34/14; E21B 34/142; E21B 43/26; E21B 2034/007; E21B 2200/06

See application file for complete search history.

(56) References Cited

U.S. PATENT DOCUMENTS

| | | | | |
|---|---|---|---|---|
| 4,520,870 A * | 6/1985 | Pringle | E21B 34/14 | 166/317 |
| 5,320,178 A * | 6/1994 | Cornette | E21B 7/00 | 166/278 |
| 5,829,520 A * | 11/1998 | Johnson | E21B 43/086 | 166/250.01 |
| 6,253,861 B1 * | 7/2001 | Carmichael | E21B 21/103 | 175/237 |
| 7,703,510 B2 * | 4/2010 | Xu | E21B 43/26 | 166/177.5 |
| 7,971,646 B2 * | 7/2011 | Murray | E21B 43/02 | 166/332.4 |
| 8,297,358 B2 * | 10/2012 | Korkmaz | E21B 34/14 | 166/308.1 |

(Continued)

*Primary Examiner* — Jennifer H Gay

(74) *Attorney, Agent, or Firm* — Pierson Intellectual Property LLC

(57) ABSTRACT

Example of the present disclosure relate to frac sleeve with set of inner sleeves that allow selective open and close of such sleeves, where clusters of the same frac sleeves to be treated top to bottom.

19 Claims, 7 Drawing Sheets

(56) References Cited

U.S. PATENT DOCUMENTS 8,733,445 B2 * 5/2014 Huang ..... E21B 43/26 166/332.4
8,863,853 B1 * 10/2014 Harris ..... E21B 23/004 166/386
9,187,994 B2 * 11/2015 Themig ..... E21B 43/162
9,279,312 B2 * 3/2016 King ..... E21B 34/14
9,574,421 B1 * 2/2017 Saraya ..... E21B 34/142
9,739,127 B2 * 8/2017 Purkis ..... E21B 43/14
10,260,314 B2 * 4/2019 Saraya ..... E21B 34/10
10,400,555 B2 * 9/2019 Saraya ..... E21B 43/08
10,662,739 B2 * 5/2020 Saraya ..... E21B 34/10
10,731,438 B2 * 8/2020 Hazel ..... E21B 34/066
2006/0124310 A1 * 6/2006 Lopez de Cardenas ..... E21B 43/08 166/313
2009/0044944 A1 * 2/2009 Murray ..... E21B 43/02 166/308.1
2009/0056934 A1 * 3/2009 Xu ..... E21B 43/26 166/244.1
2009/0084553 A1 * 4/2009 Rytlewski ..... E21B 43/08 166/305.1
2011/0278017 A1 * 11/2011 Themig ..... E21B 34/14 166/373
2011/0284232 A1 * 11/2011 Huang ..... E21B 34/06 166/317
2012/0000641 A1 * 1/2012 Panga ..... E21B 43/08 166/51
2012/0012322 A1 * 1/2012 Korkmaz ..... E21B 34/14 166/308.1
2012/0048559 A1 * 3/2012 Ganguly ..... E21B 43/26 166/308.1
2012/0234545 A1 * 9/2012 Xu ..... E21B 43/26 166/308.1
2013/0168099 A1 * 7/2013 Themig ..... E21B 43/08 166/308.1
2015/0053408 A1 * 2/2015 Purkis ..... E21B 43/14 166/308.1
2016/0326836 A1 * 11/2016 Gonzalez ..... E21B 43/26
2017/0044675 A1 * 2/2017 Xu ..... B22D 17/007
2017/0370185 A1 * 12/2017 Saraya ..... E21B 34/063
2018/0163510 A1 * 6/2018 Cleven ..... E21B 34/14
2018/0298728 A1 * 10/2018 Saraya ..... E21B 34/142
2019/0071953 A1 * 3/2019 Saraya ..... E21B 43/26
2019/0178053 A1 * 6/2019 Saraya ..... E21B 34/10
2019/0203566 A1 * 7/2019 Saraya ..... E21B 34/063
2019/0345798 A1 * 11/2019 Saraya ..... E21B 34/10
2020/0173255 A1 * 6/2020 Akkerman ..... E21B 34/14

* cited by examiner

METHODS AND SYSTEMS FOR CONTROLLING SUBSTANCES FLOWING THROUGH IN AN INNER DIAMETER OF A TOOL

CROSS-REFERENCE TO RELATED APPLICATIONS

This application shares inventors with U.S. Ser. No. 14/987,559, PCT/US16/68315, U.S. Ser. No. 15/191,440, and PCT/US17/36182, which are fully incorporated herein by reference in its entirety.

BACKGROUND INFORMATION

Field of the Disclosure

Example of the present disclosure relate systems and methods for controlling fluid flowing through an inner diameter of a tool. More specifically, embodiments disclose utilizing a screen positioned on a production port to limit materials from flowing into the inner diameter of a tool.

Background

Hydraulic fracturing is the process of creating cracks or fractures in underground geological formations. After creating the cracks or fractures, a mixture of water, sand, and other chemical additives, are pumped into the cracks or fractures to protect the integrity of the geological formation, prevent its closure and enhance production of the natural resources. The cracks or fractures are maintained opened by the mixture, allowing the natural resources within the geological formation to flow into a wellbore, where it is collected at the surface.

Additionally, during the fracturing process, other materials and tools may be pumped through frac sleeves to enhance the production of the natural resources. One of the tools pumped through the frac sleeves are frac-balls. The frac-balls are configured to block off or close portions of a well to allow pressure to build up. This pressure build up causes cracks or fractures in the geological formations or closes these openings to isolate existing fracture to prevent production of un-required fluid or treating unrequired zones.

When a properly sized frac-ball is positioned within a corresponding frac sleeve, the positioning of the frac-ball exerts pressure causing the frac sleeve activation or opening, consequently causing the pressure to fracture or crack in the geological formation. At the completion of each fracturing stage, a larger sized frac-ball is injected into the completion string, which opens up the next frac sleeve. This process repeats until all of the frac sleeves are opened, and multiple fractures are created in the wellbore.

In other applications, a frac-pack can be utilized using a retrievable bridge plug to be set below required treated zone, a perforating gun or any other method to perforate a zone above or create communication, after that a retrievable packer is conveyed using stick pipe or Coiled tubing to depth above communication ports (perforated zones), set and then treatment is applied through the conveying method to treat the formation. Once treatment is concluded the packer is retrieved and then the bridge plug and sand screens are lowered into the well and sand is pumped around it before the well is put on production.

Thus, conventional wellbores force fracturing to occur at the lowest frac sleeve first. This causes completion strings to be prone to accumulate undesired sand or mixtures in the wellbore after a fracking stage.

Also in conventional frac pack, various tools and trips are required to pump sand and then prevent sand from being produced back during production Accordingly, needs exist for system and methods utilizing a frac-sleeve or screen sleeve with an upper sleeve and a lower sleeve that include a fracturing port and a production port with a screen, wherein the sleeves may be configured to reduce, limit, eliminate sand from entering an inner diameter of the tool once its pumped.

SUMMARY

Embodiments disclosed herein describe fracturing systems with an upper sleeve and lower sleeve, wherein the upper sleeve and lower sleeve are configured to selectively or individually cover a frac port and a production port or just one set of ports that can be used for production and fracture. Embodiments may include a frac sleeve with an outer sidewall, lower sleeve, and upper sleeve.

The outer sidewall may include an outer frac port, a production port, or just one set of ports that can be used for production and fracing with multiple locking mechanisms, and a linearly adjustable member. In embodiments, the production port may be angled to minimize the distance between second ends of the production port and the frac port, while increasing the distance between the first ends of the production port and the frac port. In embodiments, the first ends of the production port and the frac port may be positioned within the frac sleeve, and the second ends of the production port and the frac port may be positioned outside of the frac sleeve. Accordingly, the production port and the frac port may traverse, extend across, be positioned through, etc.

The lower sleeve may include an first active port and a first ball seat. The first active port may be configured to be aligned with either the frac port or the production port or just one set of ports in case production ports and frac ports are the same, when either the frac port or the production port is active. The first active port may be configured to be misaligned with the frac port and the production port are not active.

The upper sleeve may include a second active port and a second ball seat. The second active port may be configured to be aligned with the production port, when the production port is active or just one set of ports in case production ports and frac ports are the same. The positioning of the second active port may not determine if the frac port is active or not active. In embodiments, the second active port may include a screen, which may be configured to limit the amount of sand, environment, fluids, etc. from entering the inner diameter of the system when the production port is active. However, the screen may not affect the flow of fluids through the frac port.

In embodiments, a first frac-ball may be dropped within the inner diameter of the system, pass through the second ball seat, and be positioned on the first ball seat. When the first frac-ball is positioned on the first ball seat, pressure may be applied within the frac sleeve to compress the linearly adjustable member. Responsive to compressing the linearly adjustable member, the lower sleeve may slide linearly within the outer sidewall, while the upper inner sleeve may remain in a fixed position.

In embodiments, responsive to linearly moving the lower sleeve, the frac port may become aligned with the first active port. When the outer frac port and first active port are aligned, fracking fluid may be transmitted from a position within the inner sleeve to a position outside of the outer sidewall via the aligned frac ports.

In embodiments, as the pressure within the frac sleeve is decreased, the linearly adjustable member may expand. Responsive to expanding the linearly adjustable member, the lower sleeve may slide upward causing the first ball seat to be aligned with a first locking mechanism.

When the first ball seat is aligned with the first locking mechanism, the first ball seat may open horizontally into the first locking mechanism. Once the first ball seat open, a diameter of the lower ball seat may have a diameter that is greater than the first frac-ball. This may allow the first frac-ball to slide through the linearly adjustable member and the first ball seat. Once sliding through, the first frac-ball may fall through the first frac sleeve into a lower positioned, second frac sleeve.

Additionally, when the linearly adjustable member is elongates, expands, etc. and the first ball seat is engaged with the first locking mechanism, the first active port may be aligned with the production port which may still be part of the frac port, i.e.: long port.

In embodiments, a second frac-ball may be dropped within the system, and be positioned on the second ball seat. When the second frac-ball is positioned on the second ball seat, pressure may be applied within the frac sleeve. This pressure may move the upper sleeve downward. Responsive to sliding the upper inner sleeve downward, the production port may be aligned with the first active port and the second active port. This may allow the production port to be activated.

To this end, embodiments may utilize two different ports, wherein a first port may be used for fracturing and stimulation and a second port may be used for production, wherein the second port utilizes a screen positioned within the upper sleeve. The upper and lower frac sleeves may be used independently to open and close the different ports, wherein the upper sleeve, via the screen, is also configured to limit sand and other materials from entering the inner diameter of the system when producing.

These, and other, aspects of the invention will be better appreciated and understood when considered in conjunction with the following description and the accompanying drawings. The following description, while indicating various embodiments of the invention and numerous specific details thereof, is given by way of illustration and not of limitation. Many substitutions, modifications, additions or rearrangements may be made within the scope of the invention, and the invention includes all such substitutions, modifications, additions or rearrangements.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

Figure 1:
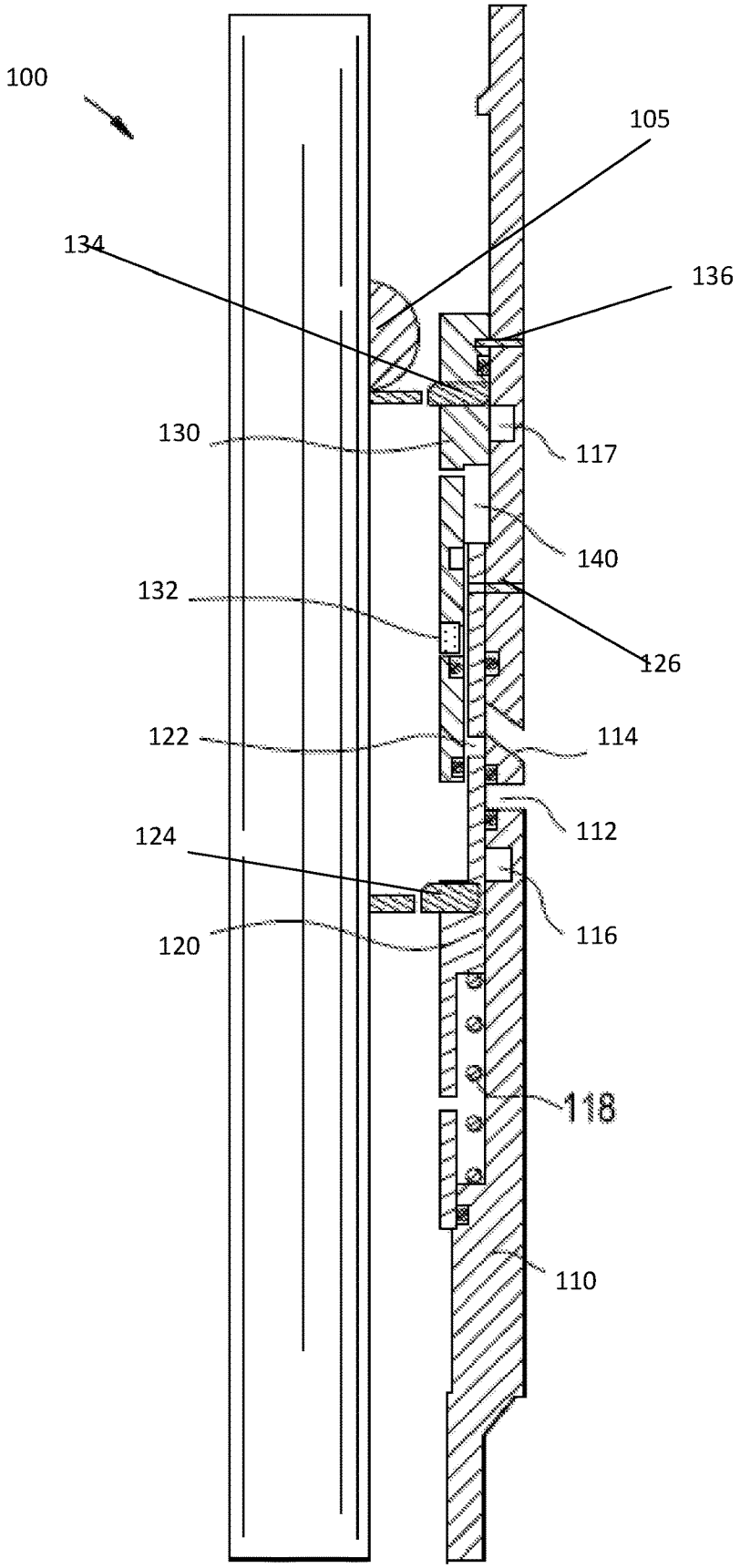
FIG. 1 depicts a frac sleeve, according to an embodiment, according to an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Examples of the present disclosure relate to a frac sleeve with various inner sleeves and ball seats. More specifically, embodiments include inner sleeves and ball seat within a frac sleeve configured to allow a single frac-ball to independently open or close plurality of zones associated with a plurality of frac sleeves while still treat or pinpoint each zone independent from the other.

Turning now to FIG. 1, FIG. 1 depicts a frac sleeve system 100, according to an embodiment. A single wellbore may include a plurality of frac sleeves 110, which may be vertically, linearly, etc. aligned across their axis or axis's. System 100 may include an outer sidewall 110, linearly adjustable member 118, lower sleeve 120, and upper sleeve 130, wherein a hollow chamber extends through system 100.

Outer sidewall 110 may be configured to be positioned adjacent to a wellbore wall, and may include frac port 112, production port 114, first locking mechanism 116, and second locking mechanism 117.

Frac port 112 may be an opening, orifice, etc. extending through outer sidewall 110. Frac port 112 may be configured to control the flow of fluid, fracking materials, natural resources and any fluid through the hollow chamber. In embodiments, frac port 112 may be configured to be misaligned and aligned with a first active port 122 positioned through lower sleeve 120. When misaligned with the first active port 122 within lower inner sleeve 120, frac port 112 may be sealed. When aligned with the first active port 122 within lower inner sleeve 120, frac port 112 may allow frac sleeve 100 to be active and operational.

Production port 114 may be an opening, orifice, etc. extending through outer sidewall 110. Production port 114 may be vertically offset from frac port 112, such as production port 114 may be positioned closer to a proximal end of outer sidewall 110 than frac port 112. Production port 114 may be filled with or include variable material. For example, production port 114 may be filled with a dissolvable material that may be removed after a certain amount of time or after fluid pressure is applied to the removable material or after certain fluid is pumped around. In other embodiments, the removable material may be a door, flap, entrance, etc. that is configured to extend through the production port 114. The door may seal production port 114 when extended. However, the door may be configured to rotate, move, etc. to be recessed in outer sidewall 110, etc. When rotated or moved, the door may form an opening through production port 114. Furthermore, frac port 112 may be positioned below angled production port 114. Production port 114 may be positioned at a downward slope from the hollow chamber towards the circumference of outer sidewall 110. Accordingly, a distance between the first ends of production port 114 and frac port 112 may be greater than a distance between the second ends of production port 114 and frac port 112. This may assist in well utilization, production, injection, fracking, etc. by having a production port being in closer proximity with the point of fracking. However, in other embodiments, frac port 112 and production port 114 may be the same integrated port.

First locking mechanism 116 may be an opening, orifice, recess, profile etc. extending from the inner diameter of outer sidewall 110 towards the outer diameter of outer sidewall 110. However, the opening associated with first locking mechanism 116 may not extend completely through outer sidewall 110. Accordingly, a diameter across first locking mechanism 116 may be larger than the diameter across the inner diameter of outer sidewall 110, but less than the diameter across the outer diameter of outer sidewall 110. First locking mechanism 116 may be a recession within outer sidewall 110 that is configured to receive first ball seat 124. In embodiments, first locking mechanism 116 may be positioned below frac port 112, and above linearly adjustable member 118. Responsive to first ball seat 124 being horizontally aligned with first locking mechanism 116, the diameter of first ball seat 124 may enlarge with first locking mechanism 116. This may allow a frac ball to slide downward through first ball seat 124.

Second locking mechanism 117 may be an opening, orifice, recess, profile etc. extending from the inner diameter of outer sidewall 110 towards the outer diameter of outer sidewall 110. However, the opening associated with Second locking mechanism 117 may not extend completely through outer sidewall 110. Accordingly, a diameter across a second locking mechanism 117 may be larger than the diameter across the inner diameter of outer sidewall 110, but less than the diameter across the outer diameter of outer sidewall 110. In embodiments, second locking mechanism 117 may be positioned above frac port 112 and below production port 114. Second locking mechanism 117 may be a recession within outer sidewall 110 that is configured to receive second ball seat 134. Responsive to second ball seat 134 being horizontally aligned with second locking mechanism 117, the diameter of second ball seat 134 may change within second locking mechanism 117.

Linearly adjustable member 118 may be a device or fluid chamber that is configured to linearly move lower inner sleeve 120. For example, linearly adjustable member 118 may be a spring, hydraulic lift, etc. Linearly adjustable member 118 may be positioned below first locking mechanism 116. However, in other embodiments, linearly adjustable member 118 may be positioned in various places in relation to inner sleeve. In embodiments, a lower surface of linearly adjustable member 118 may be positioned adjacent to a lower ledge, and an upper surface of Linearly adjustable member 118 may be positioned adjacent to an upper ledge, projection, protraction, etc. on lower inner sleeve 120. Responsive to being compressed or elongated, lower sleeve 120 may slide within outer sidewall 110. When linearly adjustable member 118 is compressed or elongated, first ball seat 124 may correspondingly move.

Lower sleeve 120 may be positioned within the hollow channel, and be positioned adjacent to outer sidewall 110. In embodiments, an outer diameter of lower inner sleeve 120 may be positioned adjacent to an inner diameter of outer sidewall 110. However, in other embodiments, there may be an annular gap positioned between lower inner sleeve 120 and outer sidewall 110, wherein fluid may be configured to flow through the annular gap. Initially, lower sleeve 120 may be secured in place via shear screw 126, wherein shear screw 126 coupled lower sleeve to outer sidewall 120. Outer sidewall 110 and lower sleeve 120 may have parallel longitudinal axis, and may not include tapered sidewalls. In embodiments, lower sleeve 1200 may be positioned below upper sleeve 130. Lower sleeve 120 may include lower frac port 122 and first ball seat 124.

First active port 122 may be an opening, orifice, etc. extending through lower inner sleeve 120. First active port 122 may be configured to control the flow of fluid, fracking materials, and natural resources through the hollow chamber. In embodiments, First active port 122 may be configured to be misaligned and aligned with outer frac port 112. When First active port 122 is misaligned with outer frac port 112, the sidewalls of lower sleeve 120 may form a seal, and may not allow fluid to flow from the hollow into the geological formations via outer frac port 112. However, in other embodiments, first active port 122 may be configured to receive fluids from outer frac port 112 through the annular gap between lower inner sleeve 120 and outer sidewall 110 even if first active port 122 is misaligned from outer frac port 112 or production port 114.

First ball seat 124 may be configured to secure a frac-ball within the hollow chamber. First ball seat 124 may be comprised of two semi-circles with a hollow center, wherein the hollow center of first ball seat 124 is configured to have a variable diameter. In other words, first ball seat 124 may be substantially donut shaped. However, in other embodiments, the ball seats may be any shape or size with a passageway extending through the ball seat. Responsive to frac ball 105 sitting on first ball seat 124 and the pressure within system 100 increasing, first shear screw 126 may break. This may allow lower sleeve to be able to slide.

The variable diameter of first ball seat 124 may change based on a diameter of a structure positioned adjacent to the outer diameter circumference of first ball seat 124. Thus, first ball seat 124 may change to have a circumference substantially the same size as the structure positioned adjacent to the outer diameter of first ball seat 124. When first ball seat 124 is positioned in the hollow chamber, first ball seat 124 may have a first diameter. When first ball seat 124 is positioned within first locking mechanism 116, first ball seat 124 may have a second diameter, wherein the first diameter is smaller than the second diameter.

Upper sleeve 130 may be positioned within the hollow channel, and be positioned adjacent to outer sidewall 110. In embodiments, an outer diameter of upper sleeve 130 may be positioned adjacent to an inner diameter of outer sidewall 110. Outer sidewall 110 and upper sleeve 130 may have parallel longitudinal axis, and may not include tapered sidewalls. Initially, second shear screw 136 may upper sleeve 130 in place, wherein second shear screw 136 coupled upper sleeve 130 to outer sidewall 120. In embodiments, upper sleeve 130 may be positioned above lower sleeve 120. Upper inner sleeve 130 may include second active port 132 and second ball seat 134.

Second active port 132 may be configured to be initially positioned above a first end of production port 114. Responsive to upper sleeve 130 sliding downward and lower sleeve 120 sliding upward, Second active port 132 may be aligned with first active port 122 and production port 114. Second active port 132 may include a screen. The screen may be a cylindrical device that is configured to sit in second active port 132. The screen may include orifices of the same or different sizes embedded within a solid sidewalls. The screen is configured to limit sand or other solid materials to enter the cavity, but allow fluid to enter and exit the cavity via the orifices. Accordingly, when production port 114 is active, fluid may be able to flow through screen second active port 114 from an area outside of outer sidewall 110 into the inner diameter of system 100, while limiting sand from flowing into the inner diameter of system 100 from outside outer sidewall 110. Furthermore, because frac port 112 is covered by lower sleeve 120 when first active port 122 and second active port 132 are aligned with production port 114, sand and other solid material may not be able to enter into system 100 via frac port 112 when production port 114 is active. In embodiments, the screens in lower stages of a well may include larger orifices than the screens in higher stages of the well. The sizing of the orifices within the screens may be associated with desired pressure levels within the inner diameter of system 100 at different stages of the well.

Furthermore, by positioning the screen within system 100, having two stationary ports 112, 114 in the outer sidewall 100 and two moving ports 122, 132, system 100 may be configured to allow fracing through the first port 112, and production through the second port 114. This may more effectively and efficiently allow well production by allowing materials to freely flow in and outer of the inner diameter of system 100 in a first mode, while selectively screening materials flowing into the inner diameter of system 100 in a second mode. In further embodiments, the screen may be positioned in the lower sleeve, within the first active port. In such an embodiment, the screen may operate with a lower port, whether the lower port is a production port.

Second ball seat 134 may be configured to secure a frac-ball within the hollow chamber. Second ball seat 134 may be comprised of two semi-circles with a hollow center, wherein the hollow center of second ball seat 134 is configured to have a variable diameter. In other words, second ball seat 134 may be substantially donut shaped.

The variable diameter of second ball seat 134 may change based on a diameter of a structure positioned adjacent to the outer diameter circumference of second ball seat 134. Thus, second ball seat 134 may change to have a circumference substantially the same size as the structure positioned adjacent to the outer diameter of second ball seat 134. When second ball seat 134 is positioned adjacent to the hollow chamber, second ball seat 134 may have a third diameter. When second ball seat 134 is positioned within second locking mechanism 117, second ball seat 134 may have a fourth diameter, wherein the third diameter is smaller than the fourth diameter. Additionally, the third diameter may be greater than the first diameter of the first ball seat 124. Therefore, a frac ball may be able to pass through second ball seat 134 but not first ball seat 124.

Hydraulic vent 140 may be positioned between upper sleeve 130 and the outer sidewall 110. In embodiments, hydraulic vent 140 may include a passageway extending from the hollow inner chamber into a cavity between upper sleeve 130 and the outer sidewall 110. Hydraulic vent 140 may include a screen that is configured to not allow sand or other solid materials to enter the cavity, but allow fluid to enter and exit the cavity. Responsive to fluid entering and exiting the cavity, the fluid may be utilized to move the sleeves or allow sleeves to freely move independently from each other. In embodiments, responsive to the movement of upper sleeve 130 and lower inner sleeve 120 the height of the cavity may increase and decrease.

FIGS. 2-7 depict phases of a method 200 for operating a sliding frac sleeve 100. The operations of the method depicted in FIGS. 2-6 are intended to be illustrative. In some embodiments, the method may be accomplished with one or more additional operations not described, and/or without one or more of the operations discussed. Additionally, the order in which the operations of the method are illustrated in FIGS. 2-7 and described below is not intended to be limiting. Elements depicted in FIGS. 2-7 may be described above. For the sake of brevity, a further description of these elements is omitted.

Figure 2:
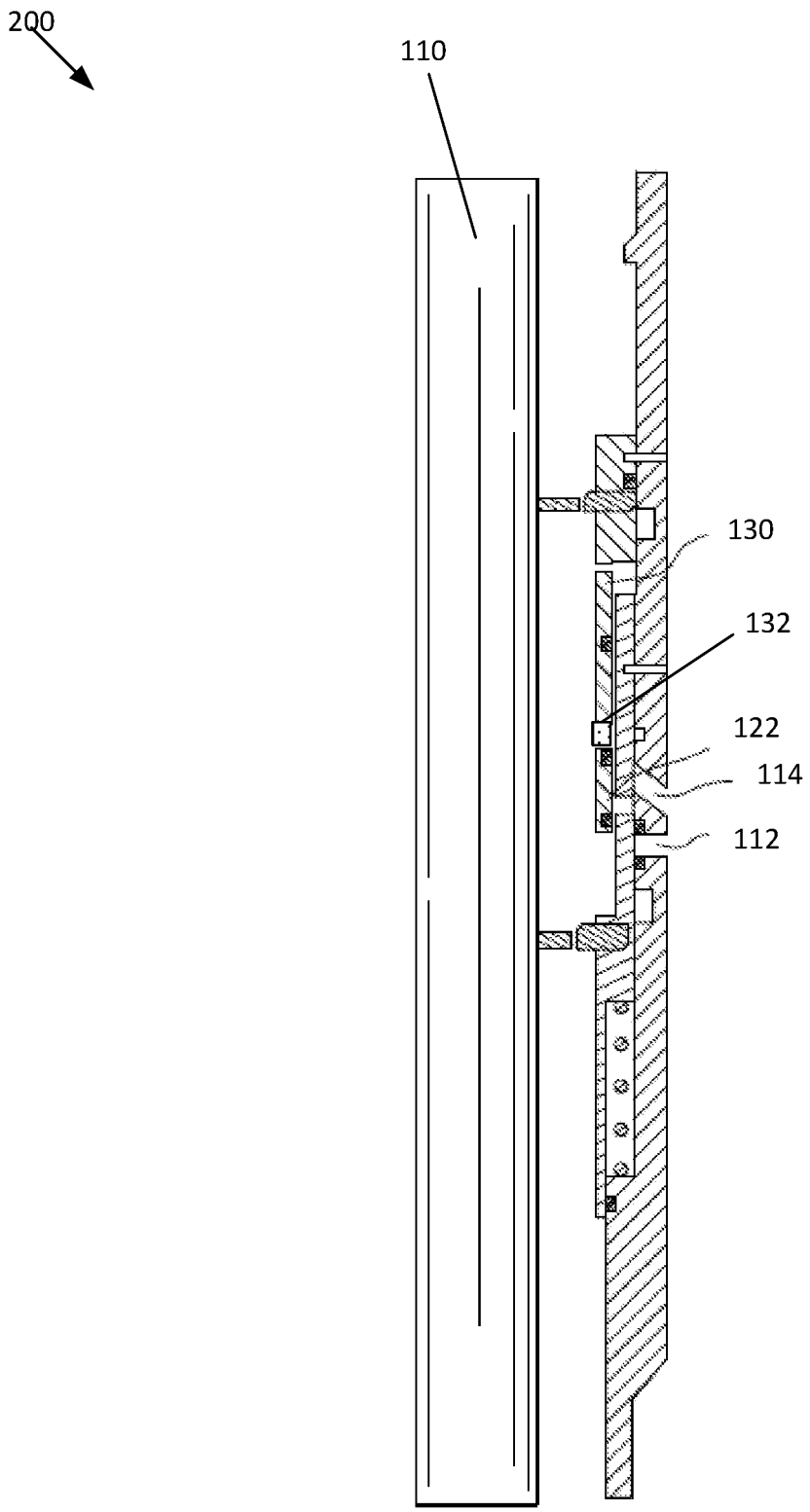
FIG. 2 depicts a first operation utilizing a frac sleeve, according to an embodiment.

FIG. 2 depicts a first operation of method 200 utilizing frac sleeve 100. At the first operation, frac sleeve 100 is in a first position. In the first position, frac port 112 and production port are misaligned with both first active port 122 and second active port 132, which are also misaligned.

Figure 3:
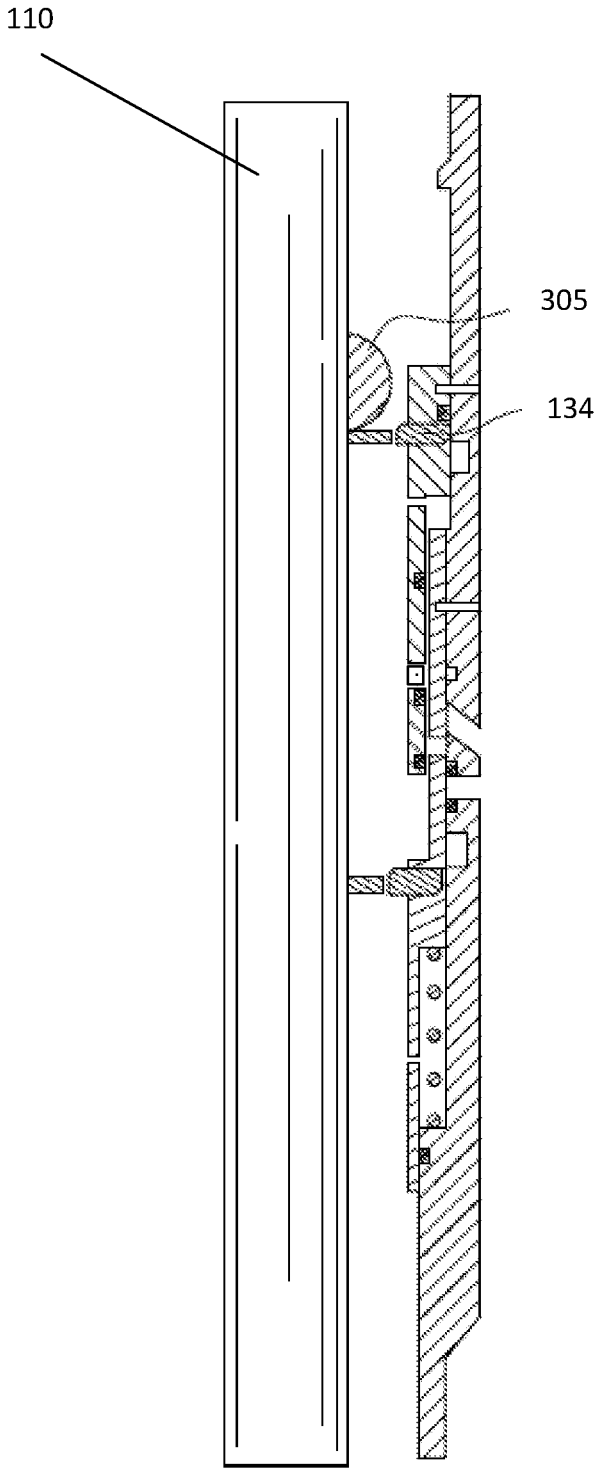
FIG. 3 depicts a second operation utilizing a frac sleeve, according to an embodiment.

FIG. 3 depicts a second operation utilizing frac sleeve 100. At the second operation, a frac-ball 305 may be dropped within the hollow chamber. Frac-ball 305 may enter the hollow chamber within frac sleeve 100 via an opening at the proximal end of frac sleeve 100, and fall towards the distal end of frac sleeve 100. In embodiments, the proximal end of frac sleeve 100 may be coupled to a distal end of another frac sleeve 900, or frac sleeve 100 may be the first frac sleeve 100 in a completion string.

Furthermore, at the second operation, frac ball 305 may pass through second ball seat 134, due to second ball seat 134 having an open inner circumference greater than that of frac ball 305.

Figure 4:
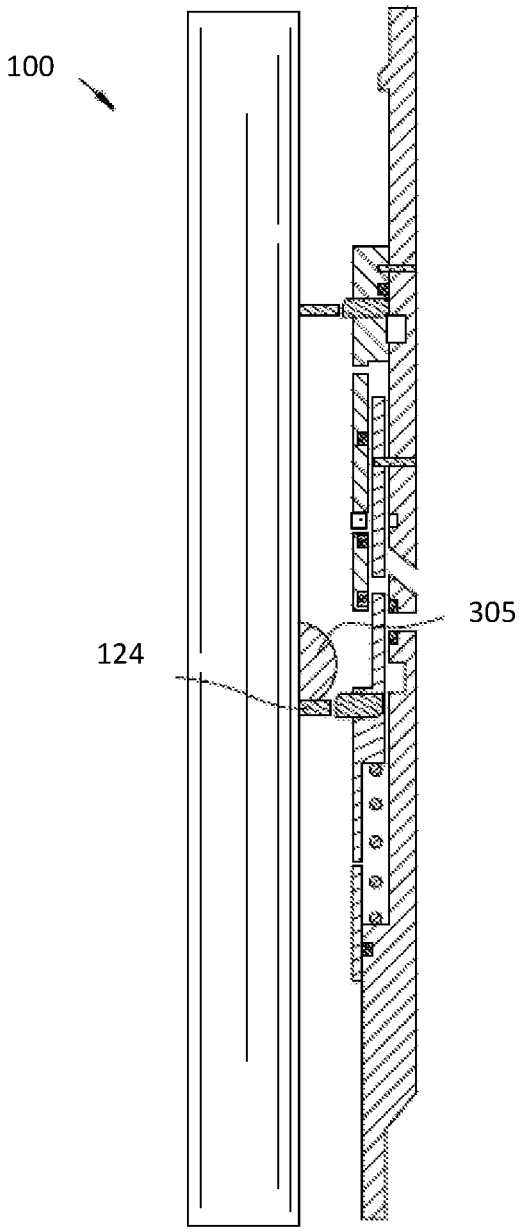
FIG. 4 depicts a third operation utilizing a frac sleeve, according to an embodiment.

FIG. 4 depicts a third operation utilizing frac sleeve 100. At the third operation, frac-ball 305 may land on an upper surface of first ball seat 124, wherein first ball seat 124 may secure frac-ball 305 in place. Furthermore, at the third operation, the outer diameter of first ball seat 124 may be substantially the same as the diameter of the inner diameter of outer sidewall 110. Additional, the inner circumference of first ball seat 124 may be less than the circumference of frac ball 305.

Also, at the third operation, pressure within the hollow chamber may build up due to frac ball 305 forming a seal on a second end of the hollow chamber by closing an opening within the center of the first ball seat 124.

Figure 5:
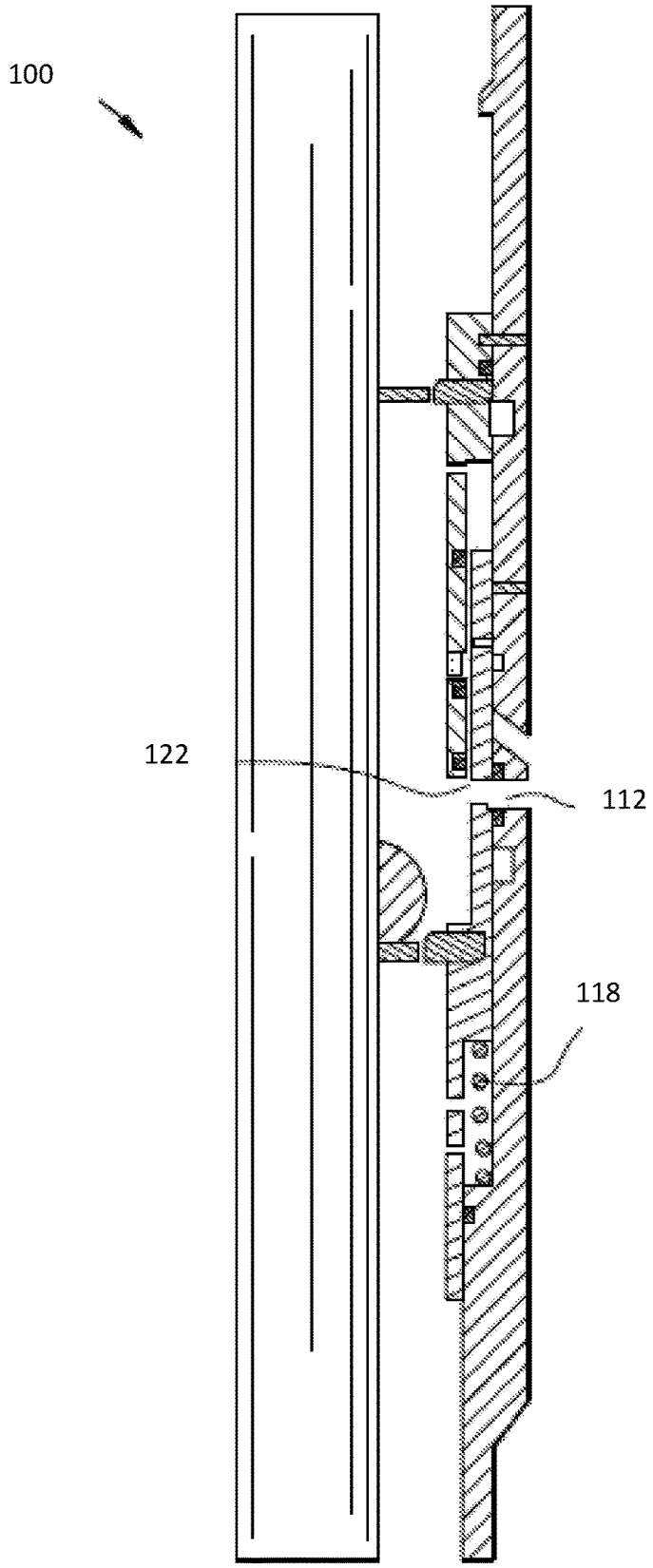
FIG. 5 depicts a fourth operation utilizing a frac sleeve, according to an embodiment.

FIG. 5 depicts a fourth operation utilizing frac sleeve 100. At the fourth operation, the pressure within the hollow chamber may increase to compress linearly adjustable member 118. This may force lower sleeve 120 downward. When lower sleeve 120 slides downward into a second position, first active port 122 may be horizontally aligned with frac port 112 and positioned below a lower surface of upper sleeve 130.

Furthermore, the movement of lower sleeve 120 may be independent of the movement of upper sleeve 130, such that upper sleeve 130 remains fixed in place.

Figure 6:
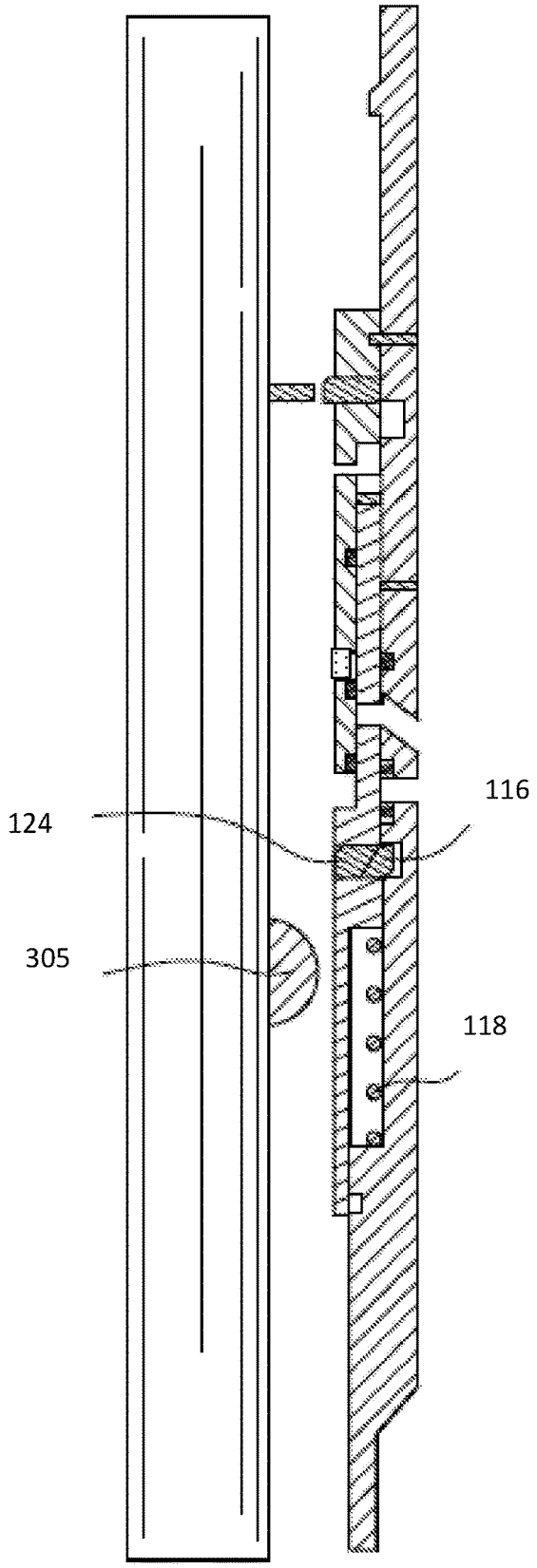
FIG. 6 depicts a fifth operation utilizing a frac sleeve, according to an embodiment.

FIG. 6 depicts a fifth operation utilizing frac sleeve 100. At the fifth operation, the pressure within the hollow chamber may decrease allowing linearly adjustable member 118 to elongate. When linearly adjustable member 118 is elongated, first ball seat 124 may be horizontally aligned with first locking mechanism 116.

When aligned, first ball seat 124 may change to increase the inner and outer circumferences of first ball seat 124. This may cause lower sleeve 120 to be locked in place. Furthermore, when the inner circumference of first ball seat 124 increases, the frac ball 305 may move downward through the hollow chamber and through the second end of frac sleeve 100.

Additionally, when first ball seat 124 is secured in place, first active port 122 may be aligned within production port 114. However, a sidewall of upper sleeve 130 may block a passageway through the aligned ports. By having the sidewall of upper sleeve 130 blocking the passageways of production port 114 and frac port 122, sand and other materials may not enter the inner diameter of system 100.

Figure 7:
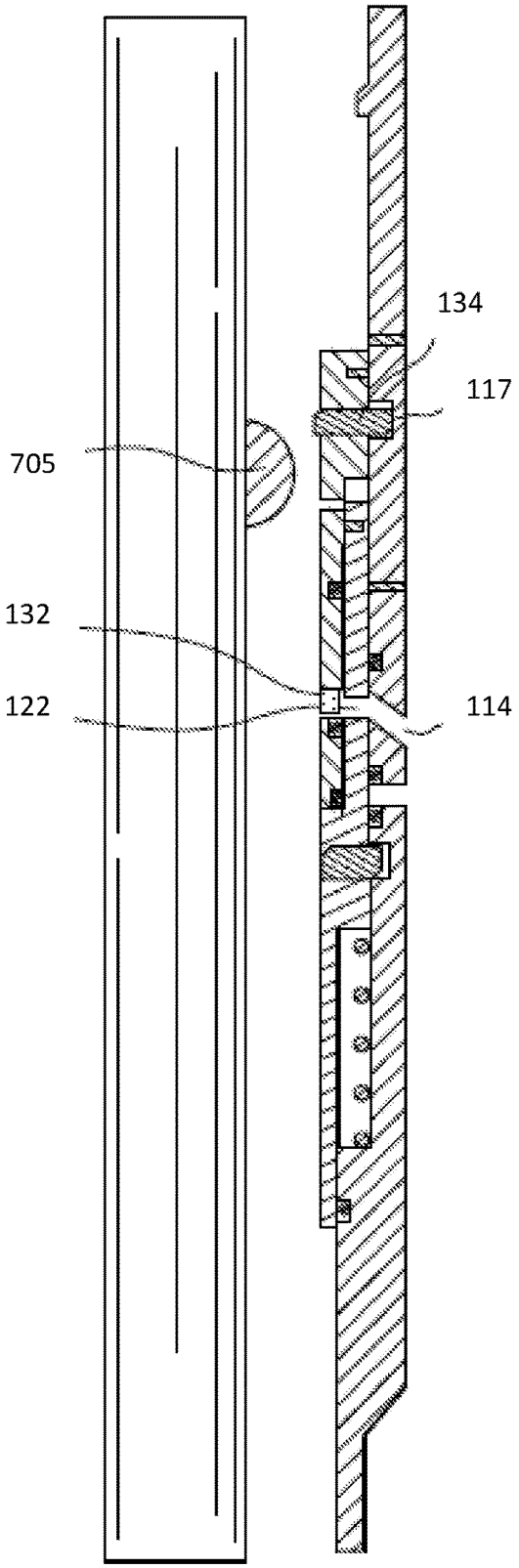
FIG. 7 depicts a sixth operation utilizing a frac sleeve, according to an embodiment.

FIG. 7 depicts a sixth operation utilizing frac sleeve 100. At the sixth operation, a second frac ball 705 may be dropped within the hollow chamber, and be positioned on second ball seat 134. Responsive to positioning second frac ball 305 on second ball seat 134, the increased pressure within the hollow chamber may slide upper sleeve 130 downward to be horizontally aligned with second locking mechanism 117. When aligned, second ball seat 134 may change to increase the inner and outer circumference of second ball seat 134. This may cause inner sleeve 130 to be locked in place. Furthermore, when the inner circumference of second ball seat 134 increases, the frac ball 305 may move downward through the hollow chamber and through the second end of system 100.

Additionally, when upper inner sleeve 130 slides downward second active port 132 may be aligned with first active port 122 and production port 114 allowing for utilization of system 100, i.e.: production, injection, etc. Furthermore, the screen within second active port 132 may be configured to filter materials flowing into system 100. Accordingly, the screen may be utilized based on the positioning and movement of the second ball seat 132, while not interfering with frac port 112 or the movement within system 100 directly associated with first ball seat 124.

However, in other embodiments, system 100 may be utilized even if first active port 122 is misaligned with production port 114. In these embodiments, materials may be configured to flow through an annulus positioned between lower inner sleeve 120 and outer sidewall 110, wherein the annulus may be formed by laterally offsetting the outer diameter of lower inner sleeve 120 from the inner dimeter of outer sidewall 110. Materials may be configured to flow into the annulus through production port 114 (or frac port 112), through the aligned first active port 122 and second active port 132, and into the hollow chamber through system 100.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or sub-combinations in one or more embodiments or examples. In addition, it is appreciated that the figures provided herewith are for explanation purposes to persons ordinarily skilled in the art and that the drawings are not necessarily drawn to scale.

Although the present technology has been described in detail for the purpose of illustration based on what is currently considered to be the most practical and preferred implementations, it is to be understood that such detail is solely for that purpose and that the technology is not limited to the disclosed implementations, but, on the contrary, is intended to cover modifications and equivalent arrangements that are within the spirit and scope of the appended claims. For example, it is to be understood that the present technology contemplates that, to the extent possible, one or more features of any implementation can be combined with one or more features of any other implementation.

The invention claimed is:

1. A fracturing device comprising:

an outer sidewall with a first outer port and a second outer port;

a first sleeve with a single first passageway, the first passageway being configured to be aligned with the first outer port in a first mode and the single first passageway being configured to be aligned with the second outer port in a second mode;

a second sleeve with a second passageway, the second passageway being configured to be aligned and misaligned with the single first passageway.

2. The fracturing device of claim 1, further comprising:

a screen positioned in the second passageway.

3. The fracturing device of claim 1, further comprising:

a dissolvable material positioned within the second outer port.

4. The fracturing device of claim 1, wherein the second passageway is not aligned with the first outer port in the first mode.

5. The fracturing device of claim 4, wherein the second passageway is aligned with the second outer port in the first mode.

6. The fracturing device of claim 1, further comprising:

a first ball seat on the first sleeve.

7. A fracturing device comprising:

an outer sidewall with a first outer port and a second outer port;

a first sleeve with a first passageway, the first passageway being configured to be aligned with the first outer port in a first mode and the first passageway being configured to be aligned with the second outer port in a second mode;

a second sleeve with a second passageway, the second passageway being configured to be aligned and misaligned with the first passageway;

a ball seat on the second sleeve, wherein the first sleeve is positioned between the second sleeve and the outer sidewall.

8. The fracturing device of claim 1, wherein the second passageway is positioned closer to a proximal end of the fracturing device than the first outer port and the second outer port in the first mode.

9. The fracturing device of claim 8, wherein the second sleeve is configured to be aligned with the second outer port and the single first passageway in the second mode.

10. A method of operating a fracturing device comprising:

moving a first sleeve within an outer sidewall to align a single first passageway within the first sleeve with a first outer port in a first mode;

moving the first sleeve within the outer sidewall to align the single first passageway with a second outer port in a second mode;

moving a second sleeve to align and misalign a second passageway within the second sleeve the single first passageway.

11. The method of claim 10, further comprising:
positioning a screen in the second passageway.

12. The method of claim 10, further comprising:
positioning a dissolvable material within the second outer port.

13. The method of claim 10, further comprising:
misaligning the second passageway with the first outer port in the first mode.

14. The method of claim 13, further comprising:
aligning the second passageway with the second outer port in the first mode.

15. The method of claim 10, further comprising:
positioning a first object on a first ball seat within the first sleeve.

16. The method of claim 15, further comprising:
positioning a second object on a second ball seat within the second sleeve.

17. The method of claim 10, wherein the first sleeve is positioned between the second sleeve and the outer sidewall.

18. The method of claim 10, wherein the second passageway is positioned closer to a proximal end of the fracturing device than the first outer port and the second outer port in the first mode.

19. The method of claim 18, further comprising:
aligning the second passageway with the second outer port and the single first passageway in the second mode.

* * * * *